US010497213B2

(12) United States Patent
Morton et al.

(10) Patent No.: US 10,497,213 B2
(45) Date of Patent: Dec. 3, 2019

(54) METHOD OF UTILIZING TOKENS WITHIN GAMING, GAMBLING AND PARTY SYSTEMS

(71) Applicant: Flowplay, Inc., Seattle, WA (US)

(72) Inventors: Derrick Morton, Seattle, WA (US); Douglas Pearson, Seattle, WA (US); Scott Pultz, Seattle, WA (US)

(73) Assignee: FlowPlay, Inc., Seattle, WA (US)

( * ) Notice: Subject to any disclaimer, the term of this patent is extended or adjusted under 35 U.S.C. 154(b) by 99 days.

(21) Appl. No.: 15/832,940

(22) Filed: Dec. 6, 2017

(65) Prior Publication Data

US 2018/0158281 A1 Jun. 7, 2018

Related U.S. Application Data

(60) Provisional application No. 62/430,704, filed on Dec. 6, 2016.

(51) Int. Cl.

| | |
|---|---|
| ***A63F 9/24*** | (2006.01) |
| ***G07F 17/32*** | (2006.01) |
| *G07F 17/34* | (2006.01) |

(52) U.S. Cl.

CPC ..... *G07F 17/3248* (2013.01); *G07F 17/3225* (2013.01); *G07F 17/3241* (2013.01); *G07F 17/3272* (2013.01); *G07F 17/3293* (2013.01); *G07F 17/34* (2013.01)

(58) Field of Classification Search

CPC ..... G07F 17/3244; G07F 17/3255; G07F 17/3258; G07F 17/3262; G07F 17/3272; G07F 17/3276; G07F 17/3279

See application file for complete search history.

(56) References Cited

U.S. PATENT DOCUMENTS

| | | | | |
|---|---|---|---|---|
| 7,052,392 | B2 | 5/2006 | Tessmer et al. | |
| 7,740,534 | B2 | 6/2010 | Walker et al. | |
| 8,197,336 | B2 * | 6/2012 | Ellis | G07F 17/3286 463/26 |
| 8,231,448 | B2 | 7/2012 | Cuddy et al. | |
| 9,235,966 | B2 | 1/2016 | Bigelow, Jr. et al. | |
| 9,275,510 | B2 | 3/2016 | Anderson et al. | |
| 9,336,652 | B2 | 5/2016 | Arezina et al. | |
| 2005/0215311 | A1 * | 9/2005 | Hornik | G07F 17/32 463/20 |

(Continued)

FOREIGN PATENT DOCUMENTS

| | | |
|---|---|---|
| WO | 2015042600 | 3/2015 |

*Primary Examiner* — Lawrence S Galka

(74) *Attorney, Agent, or Firm* — Emerson, Thomson & Bennett, LLC; Roger D. Emerson

(57) ABSTRACT

Provided is a method of utilizing tokens or charms within gaming, gambling or party systems. The system is typically incorporated into a computer software program which operates an online gaming system. The gaming system may also provide a virtual casino for multiple players to participate in and play together. The method described herein incorporates the use of tokens or charms to provide players with an impression of enhanced winnings and may be used as an alternative to the traditional model of requiring players to purchase additional game currency to continue game play. The tokens or charms may also be used a social component of games involving multiple players as players may be permitted to purchase tokens or charms for each other.

19 Claims, 4 Drawing Sheets

(56) References Cited

U.S. PATENT DOCUMENTS

| | | | | |
|---|---|---|---|---|
| 2006/0160613 | A1* | 7/2006 | Hornik | G07F 17/32 463/25 |
| 2007/0105620 | A1* | 5/2007 | Cuddy | G07F 17/32 463/26 |
| 2008/0076530 | A1 | 3/2008 | Kulas | |
| 2013/0005441 | A1* | 1/2013 | Ellis | G07F 17/3267 463/25 |
| 2013/0331968 | A1* | 12/2013 | Newton | A63F 13/798 700/92 |

* cited by examiner

METHOD OF UTILIZING TOKENS WITHIN GAMING, GAMBLING AND PARTY SYSTEMS

I. BACKGROUND

A. Field of the Invention

The present disclosure is related to a method of utilizing tokens within gaming, gambling and party systems. The tokens utilized in such systems provide users with an impression of enhanced winnings and encourage continued game play.

B. Description of Related Art

Computer based gaming systems that utilize game currency throughout the play of a game are well known within the gaming industry. In most instances, a certain amount of game currency is initially provided to the player free of charge to allow the player to begin playing the game. However, in some cases, the game may require that the player purchase a certain amount of game currency in order to begin playing the game. These gaming systems typically have a payout of approximately 92 to 96%. This means that the player loses approximately between 4 to 8% of the time. Thus, a player who receives or purchases this initial game currency ensures his ability to play the game continuously by either winning additional game currency throughout play of the game or by purchasing additional game currency when the player's game currency is about to run out. The reality, however, is that over a long enough period of time, the player will ultimately lose all of his or her game currency unless additional currency is purchased.

Various modifications to this existing gaming model have been developed. For example, in the gambling industry, gaming systems have been developed which allow players to purchase points which may be used to not only immediately place additional wagers but also to modify the game by receiving extra items, to customize the game through access to certain customization options and to even change the rules of the game to provide for more favorable outcomes or the perception of a more favorable outcome. Other perks associated with purchased points have linked purchased points or game currency to suggestions as to what the player's next bet should be and changes in the pay-out table.

Gaming systems within the gambling industry have also been developed which allow other players other than the primary player to pay to improve a primary player's odds or chances of winning, to guarantee that the primary player collects a jackpot or to increase the effective bet of the primary player.

What is needed, however, within the gaming industry is a bonus system which is not linked to a random event but instead provides for a purchasable bonus opportunity during play of the game. Other desirable features include a bonus system which is time-based, which does not affect the primary pay-out table, which is based on a purchase event which occurs during game play and a bonus system which may be applied to the purchasing player as well other players. These and other advantages of the present disclosure are discussed in detail below.

II. SUMMARY

Provided is a method of operating a gaming system including the following steps: offering for sale at least one token for sale wherein the token has a value corresponding to a duration of a bonus event and an increased payout during the duration of the bonus event; collecting, by the gaming system, a fee related to the purchase of the token; processing and activating a bonus associated with a purchased bonus token; processing the bonus associated with the purchased bonus token by the gaming system; processing a wager associated with a player incorporating the purchased bonus token by the gaming system; determining the outcome of the wager based on the purchased bonus token by the gaming system; and revealing the outcome of the wager to the player by the gaming system.

Also provided is a method of operating a gaming system which includes the following steps: offering for sale at least one token for sale to be purchased by multiple players within a gaming system room, wherein the token has a value corresponding to a duration of a bonus event and an increased payout during the duration of the bonus event, wherein at least one token is required for purchase by any player who desires to obtain admission to play within the gaming system room; collecting, by the gaming system, fees related to the purchase of the tokens; processing and activating a bonus associated with the purchased bonus tokens, wherein the bonus is applied to all players who have obtained entry into the gaming system room; processing the bonus associated with the purchased bonus tokens by the gaming system; processing a wager associated with a primary player incorporating both the primary player's and the secondary players' purchased bonus tokens by the gaming system; determining the outcome of the wager based on the applied bonus tokens by the gaming system; and revealing the outcome of the wager to the primary player by the gaming system.

Numerous benefits and advantages of this invention will become apparent to those skilled in the art to which it pertains upon reading and understanding of the following detailed specification.

III. BRIEF DESCRIPTION OF THE DRAWINGS

IV. DETAILED DESCRIPTION

Figure 1:
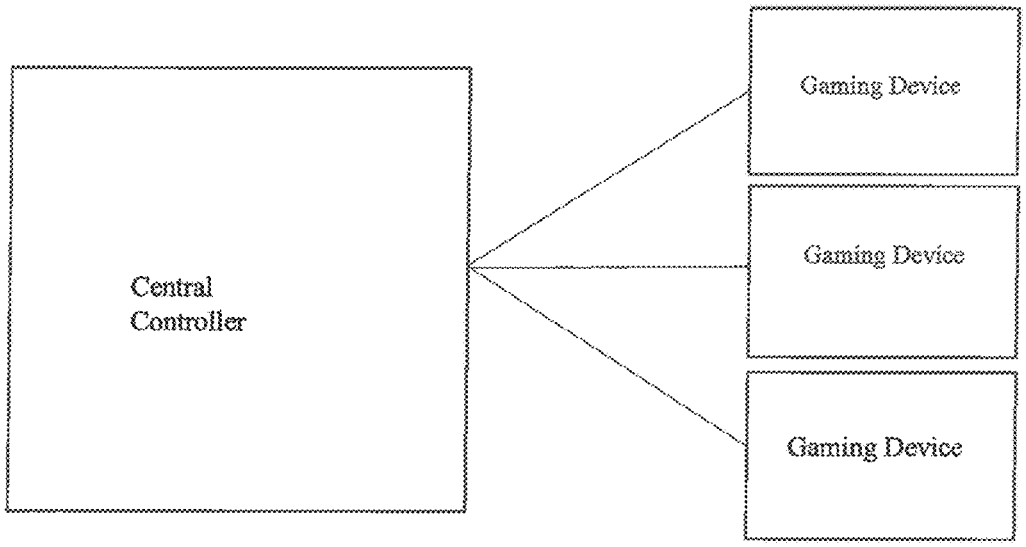
FIG. 1 is a schematic block diagram of an exemplary embodiment of a network configuration of several gaming devices.

The present disclosure relates to a method of utilizing tokens within various types of gaming, gambling and party systems. The types of games the method may be used for include casino type games, video-games and on-line games. In certain embodiments, the method may be used within games which depict a virtual reality involving multiple players and game rooms. In certain embodiments, the method is utilized within online gaming systems that consist of online virtual reality gambling systems.

When a player wishes to start a game such as an online gambling game such as poker, blackjack or roulette, for example, he or she is either initially provided with a certain amount of coins (or other form of game currency) to begin game play for free or alternatively, must buy into the game by purchasing a certain amount of coins to place wagers to initiate game play. The odds for such games are often stacked against the players. Although a player may experience a period of time where he or she wins a certain number of hands, if the player continues to play the game over a period of time, he or she will lose more often than not resulting in the player diminishing his or her stockpile of coins or game currency. The result is that many game players will end up terminating the game relatively quickly as they lose game currency as well as funds they have allocated to purchase game currency. This effect has a discouraging effect on continued game play.

In order to provide an enhanced gaming experience for all players and to provide an improved business model for the house, the present method provides a means for players to essentially extend their length of play while at the same time providing such players with a perception of enhanced winnings. This means is accomplished by the use of tokens within the game.

In certain cases, individuals who are seeing their stockpiles of game currency or winnings diminish will be provided with an option within the game to purchase a token, also referred to as a charm. The tokens are programmed to be effective for a certain period of time over the duration of a game. The tokens are also accorded a specific value with respect to the amount of game currency that is to be awarded over time depending on the purchase price of the token. For example, a token having a purchase price of $1 for a beer charm might have a game currency value of 10,000 coins that is to be awarded over a certain period of time, whereas a token having a purchase price of $5 for a caviar charm might have a game currency value of 100,000 coins that is to be awarded over a certain period of time during play of the game. The gaming system may include any number of charms having various purchase prices and various game currency values. Thus, each charm's game currency value may be directly dependent upon the purchase price of the charm with charms having a more expensive purchase price having a greater game currency value than charms having a less expensive purchase price. It should be understood that in certain embodiments, the charm is not designed to modify the underlying game that is being played, but rather, only modifies the payout to the user who purchases or benefits from the charm.

As mentioned above, the tokens or charms are designed to encourage continued game play and enjoyment for the players while also allowing for the venue hosting the game to generate increased revenue. In order to accomplish this, the token or charm may be applied in one of several ways. For example, if a charm is applied to a particular hand and the player loses that hand, the player would either not register a loss on his gaming account but would instead register a win or would register a much smaller loss than he or she would have had the charm not been applied to the hand. In another scenario, if the charm is applied to a particular hand and the player wins the hand, the player would win much more game currency on the hand than he or she would have had charm not been purchased and applied to the hand. In certain embodiments, the charm is designed to be applied only to winning hands.

As further mentioned above, tokens or charms are typically designed to last for a specific period of time depending on the value or purchase price of the token or charm. In other words, the more expensive or higher in value the token or charm is, the longer the period of time it is applied to the player or players of the game. For example, a charm that costs $0.10 may be designed to last for a few minutes (e.g., 2 or 3 minutes) whereas a more expensive charm that costs $17.00 may be designed to last for half an hour. In an alternative embodiment, however, the method may be modified so that the tokens or charms apply to a certain number of game plays or hands depending on the value or purchase price of the token or charm.

In certain embodiments, the player may be provided with an option to activate a token or charm after purchase. The player may also be permitted to accumulate multiple unactivated tokens or charms which are stored within a bank or account for later activation. Thus, the tokens or charms may be activated by the individual players at their discretion while they are playing a particular game or they may be applied to other games that the player might participate in. However, in certain embodiments, the gaming system may be designed so that the tokens or charms would be automatically activated after purchase while the player is playing a particular game. In further embodiments, the gaming system automatically activates the token or charms after purchase and automatically initiates a bonus event applying the purchased tokens or charms to the player's wagers.

It should be understood that the tokens or charms are not designed to increase the odds of winning the game. These odds remain the same as the tokens or charms do not affect the underlying game. Instead, the tokens or charms are designed to affect the players' perception of winning by either awarding a winning hand when the hand was actually a losing hand, by awarding a winning hand that is much greater in value than would be awarded without the token or charm or by collecting a losing hand that is much smaller than what would have been collected without the token or charm. However, it is possible that the gaming system could be modified in certain embodiments to allow the token or charm to modify the odds of winning or losing the game for a specific period of time or to be used only for a certain amounts of game plays depending on the purchase value of the token or charm.

Thus, the purchase price of the tokens is directly related to the value of the tokens in terms of game currency which is allocated to players over a specific period of time directly related to the value of the token (i.e., the more expensive or greater value of the token, the longer the bonus round associated with the token). At the end of the time allocated for the bonus round, the player will have received the full value of the token which he or she had purchased. For example, if a player purchases a charm worth 10,000 coins in game currency and this type of charm is designed to provide a bonus round that lasts for 10 minutes, the game is designed to allocate the entire 10,000 points to the player throughout the player's winnings and losses by the end of 10 minutes. It should be understood, however, that the time period for allocating bonus coins or points may vary depending on how the bonus points are allocated to the player and the player's total winning and losing hands or plays during the time period of the bonus round. For example, if bonus points are only awarded to the player's winning hands and the player experiences a losing streak, it is possible that the bonus round may last longer than 10 minutes in order for the player to obtain the entire value of the purchased token. Likewise, if the bonus points are only awarded to the player's losing hands and the player experiences a winning streak, it is possible that the bonus round may last less than 10 minutes since the player could receive the entire 10,000 value of the purchased token more quickly on his winning hands.

In a further embodiment, the method disclosed herein is designed to be applied to games involving multiple players. Games which involve multiple players may include social casinos and games which include virtual game rooms. In a social casino setting, each player has the opportunity to purchase a token or charm. When a player decides to purchase a token or charm, every other player in the room, including the player who purchases the token or charm, receives a token or charm as well. In certain embodiments, however, the method disclosed herein may only allow a player to purchase a token or charm as a gift for one or more other players of the game. The result is that the player who purchases the token or charm does not receive the benefit of the token or charm that he or she purchased. In the social gaming setting, this embodiment creates a scenario where the player or players who receive the benefit of the purchased token or charm may desire to return the favor by purchasing a token or charm for the player who purchased a token or charm for them. As mentioned above, this feature is designed to encourage the social aspect of the game and enjoyment of the players through continued game play.

While the tokens or charms are active, each player within the room receives bonuses during play that make it appear that they are winning. The reality, however, is that each player is receiving bonuses that make up for their losses. This method allows each player's bank balance to increase and provides players with the impression that they are winning.

In another embodiment, players may schedule what is referred to as a charm party. In certain cases, these charm parties may require an admission fee to attend. For example, a player may be required to agree to purchase a certain type of charm to attend a charm party. These charm parties may be designed to have limited seats or spaces available. Once the party has filled, all of the players can receive the charms that they have all purchased. For example, if a player attends a beer charm party that has 25 people in attendance, each player would receive 25 beer charms since each player would receive the charms that the other players have purchased. These charms may be activated by the individual players at their discretion while they are attending the beer charm party or they may be applied to other parties, games or rooms that the player's might attend or participate in. However, in certain embodiments, the game may be designed so that these charms would be applied all at once while the players are within the same game room.

In certain embodiments involving multiple player games, the cost of a token or charm may depend upon the number of other players sitting within a particular room. For example, a beer charm which would normally cost $1 for an individual player might cost up to $25 if 25 players are sitting within a room. In certain embodiments, however, the cost of such a beer charm may remain the same or be slightly higher if multiple players are involved. The advantage of having this type of low pricing scheme for multiple players is that it would encourage players to purchase tokens or charms for other players within the room. In other embodiments, the value of a token might be reduced if multiple players are involved. For example, a beer charm which would normally cost $1 might cost $0.04 per player if 25 players are involved. As noted above, this type of low pricing scheme, is intended to encourage players to purchase tokens or charms for each other in a social setting.

In embodiments involving multiple player games, the charm may retain its original value as it is divided among the players. For example, if a player purchases a charm having a value of 25,000 coins, that charm would be distributed among the players equally with each player within the room receiving 25,000 coins. In other embodiments, however, the total value of a charm may be divided among the players within a room. For example, a charm having a value of 25,000 coins may be divided to 1,000 per player if 25 players are present within a room.

In further embodiments, players who receive a certain type of payout (e.g., a relatively large payout) will receive an offer by the gaming system for a chance to double their payout if they buy the other players within the room a token or charm. The gaming system may also be configured so that these other players would obtain a chance to obtain a portion of the primary player's jackpot if they in turn purchase a token or charm for either themselves or for the other players.

In further embodiments, the gaming system may be configured to provide for different classes of players. In such configurations, players can be categorized according to their game score, the number of coins or game currency they have obtained, the number of tokens or charms they have purchased or the type of token or charm that they have purchased to enter a particular room or to play a particular game. For example, a player who purchases a high value token to play a particular game may be designated as an "elite" player. Such players may be provided with access to other high value charms that are not available to other players who do not fall within the "elite" class. In such scenarios, the gaming system may be designed to immediately release a relatively large amount of game currency or coins to the "elite" player buying the charm. The "elite" player may then proceed to obtain additional or enhanced winnings throughout play of the game.

The gaming system may also provide for a charm bar in certain embodiments. A charm bar is a limit on the number of charms a player can play at any one period of time. For example, a player may have 1,000 charms stored within his or her inventory but the charm bar would limit the player to activating or using only 4 charms at a time. In such instances, the player would not be able to activate another charm until the time period for at least one of the active charms expires.

Thus, a gaming system which utilizes the charm bar feature may be described as having a feature which allows players to fill or activate charm slots during play. For example, in accordance with the previous example, a player may fill up to four charm slots. The gaming system may also include an additional feature which provides an impression of enhanced winnings where a player has filled or activated all available charm slots. For example, a player who has filled and activated all available charm slots may receive the benefit of the gaming system speeding up the release of coins or game currency to the player and/or the benefit of receiving an increased amount of coins or game currency.

Figure 4:
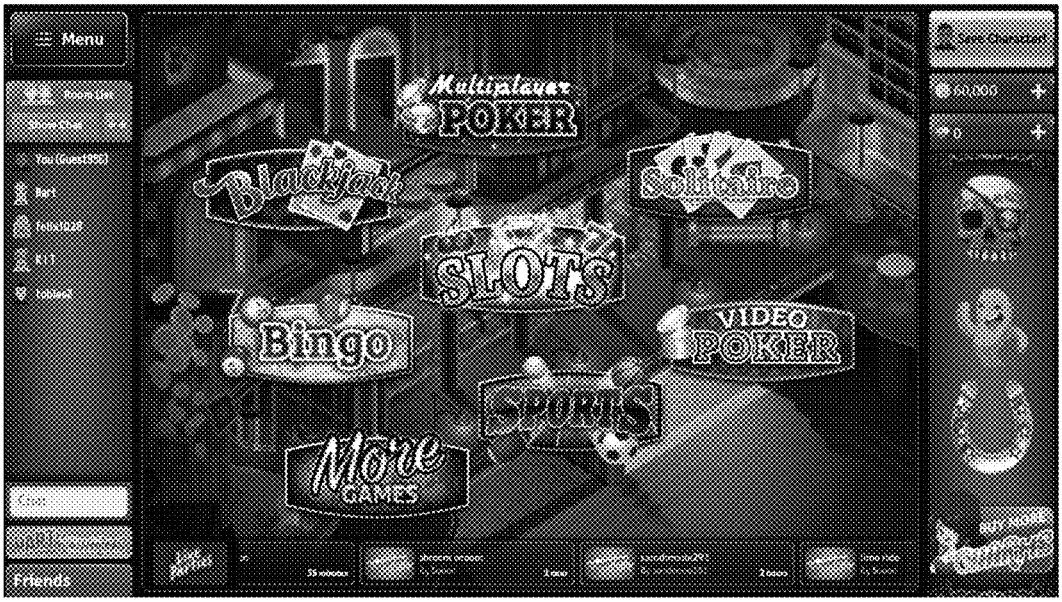
FIG. 4 is a screen shot of an exemplary gaming system.

In certain cases, the tokens or charms purchased by players may be transferrable between different rooms within the gaming system. The gaming system may be designed so that these tokens or charms are bought in certain types of rooms (e.g., party rooms), however, it is also possible that these tokens or charms are bought in any type of room. Tokens or charms may also be required as an entrance fee to enter a particular room which has limited seating. Once seating within the room has filled the player would be required to explore different rooms to continue play. FIG. 4 illustrates a screen shot of an exemplary gaming system having multiple casino games being played by multiple players. Access to different rooms, casino games, parties, hangouts (e.g., dance parties, lounge bars, etc.), an outfit store, etc. is provided through a drop down menu to encourage interaction between the players.

Accordingly, the present disclosure provides a gaming system that includes a plurality of gaming devices. Each gaming device has a processor, a memory, at least one input and a display. The memory device stores a plurality of instructions which are executed by the processor and the processor executes the operation an electronic game which includes the following steps or processes: offering for sale at least one token, wherein the token has a purchase price which corresponds to the value of the token, wherein the token has a value corresponding to an increased payout during a bonus event of a certain duration or on a specified duration of the bonus event, wherein the increased payout corresponds to a specific amount of game currency that is to be awarded during the duration of the bonus event; collecting a fee related to the purchase of the token; processing and activating a bonus associated with the purchased token, wherein the bonus comprises an amount of game currency; processing a play or hand within the gaming system; processing a wager associated with a player; processing the bonus associated with the purchased token; determining the outcome of the wager incorporating an increased payout based on a portion of the value of the purchased token; and awarding the outcome of the wager to at least one player by the gaming system, wherein the token does not modify the game that is being played and only modifies the payout to the player who purchases or benefits from the token and wherein the total value of the purchased token is awarded upon completion of the bonus event.

According to certain aspects of the present disclosure, the gaming system includes a plurality of tokens, wherein each token has a different purchase price and a different value corresponding to a specific amount of game currency that is to be awarded during the duration of the bonus event.

According to certain aspects of the present disclosure, applying a purchased token to a hand or play that the player loses results in: 1) a win being registered in the player's gaming account instead of a loss; 2) a smaller loss in the player's gaming account than the player would have had had the purchased token not been applied to the hand or play; or 3) a win being registered in the player's gaming account that is much larger than the player would have had had the purchased token not been applied to the hand or play.

According to certain aspects of the present disclosure, the purchased token has a total value that falls within a range of a first amount of game currency and a second amount of game currency, wherein the bonus event associated with the purchased token has a duration that ranges between a first time period and a second time period, wherein the processor executes a set of commands that randomly selects the amount of bonus that is awarded to the player for each play throughout the duration of the bonus event, wherein the processor executes a set of commands that randomly selects the duration of the bonus event, and wherein the processor executes a set of commands that randomly selects the amount of bonus that is awarded to the player for the duration of the bonus event and wherein the amount of bonus that is awarded to the player for the duration of the bonus event ranges between the first amount of game currency and the second amount of game currency.

According to certain aspects of the present disclosure, the increased payout has a value that is randomly generated for each play during the bonus event and wherein the total value of the increased payouts during the bonus event does not exceed the value of the purchased token.

According to certain aspects of the present disclosure, a player is provided with an option to activate a token after purchase by storing the purchased tokens within a player's account for later activation or wherein the purchased token is automatically activated after purchase.

According to certain aspects of the present disclosure, the gaming system comprises multiple players interacting with each other on a social network.

According to certain aspects of the present disclosure, the purchased token is applied to other players of the gaming system or wherein the purchased token is applied to the player who purchased the token in addition to other players of the gaming system.

According to certain aspects of the present disclosure, the gaming system comprises a charm party, wherein the charm party requires an admission fee to attend and wherein the admission fee to attend a charm party varies among different types of charm parties.

According to certain aspects of the present disclosure, the admission fee to attend a charm party requires players to purchase a token of a certain value.

According to certain aspects of the present disclosure, the player who purchases a token is a primary player, wherein players who have not purchased the token purchased by the primary player are secondary players and wherein the value of the token purchased by the primary player is to be distributed to the secondary players attending the charm party for a period of time having a duration which corresponds to the value of the purchased token.

According to certain aspects of the present disclosure, the value of a specific type of token purchased during the charm party depends on the number of players attending the charm party or wherein the value of a specific type of token purchased during the charm party does not depend on the number of players attending the charm party.

According to certain aspects of the present disclosure, the total value of the purchased token is divided among the players attending the charm party or wherein each player attending the charm party receives the total value of the purchased token.

According to certain aspects of the present disclosure, the player who purchases the token has an option to purchase tokens for individual use or for sharing with other players within a charm party and wherein the player who purchases the token has a chance to be awarded increased bonus payouts in addition to increased bonus payouts associated with the purchased token if the player purchases tokens that are to be shared with other players within the charm party.

According to certain aspects of the present disclosure, a player who purchases high value tokens obtains a classification within the gaming system that allows the player access to purchase additional higher value tokens.

According to certain aspects of the present disclosure, the processor executes a set of instructions that continuously monitors and tracks the player's score, number of shared tokens, number of winning and losing hands or plays, and duration of play in real-time to compute a social gaming score and wherein the process executes a set of commands that utilizes the social gaming score to determine different types of tokens that are available for purchase.

According to certain aspects of the present disclosure, the gaming system includes a charm bar which limits the number of tokens a player can play at any one period of time.

According to certain aspects of the present disclosure, the gaming system includes a browser-based virtual reality world having a plurality of casinos, buildings, floors and game rooms.

According to certain aspects of the present disclosure, purchased tokens and tokens obtained from other players are transferrable to different casinos, buildings, floors and game rooms within the gaming system.

According to certain aspects of the present disclosure, the gaming system comprises a plurality of games within a social casino, wherein the games within the social casino include slots, poker, bingo, solitaire, blackjack, baccarat, roulette, craps, keno, pachinko, lottery, big six wheel and any other type of game that requires a wager to be made.

Also provides is a gaming system that includes a plurality of gaming devices, wherein each gaming device has a processor, a memory, at least one input and a display, wherein the memory device stores a plurality of instructions which are executed by the processor, wherein the processor executes an electronic game which includes the following steps: offering for sale at least one token to be purchased by multiple players within an online virtual reality gaming system, wherein the token has a value corresponding to a duration of a bonus event and an increased payout during the duration of the bonus event, wherein at least one token is required for purchase by any player who desires to obtain admission to play within the gaming system room; collecting fees related to the purchase of the tokens; processing and activating a bonus associated with the purchased bonus tokens, wherein the bonus is applied to all players who have obtained entry into the gaming system room; processing the bonus associated with the purchased bonus tokens; processing a wager associated with a primary player incorporating both the primary player's and the secondary players' purchased bonus tokens by the gaming system; processing a play or hand within the gaming system; determining the outcome of the wager incorporating an increased payout based on a portion of the value of the purchased token; and revealing the outcome of the wager to the primary player by the gaming system.

Figure 2:
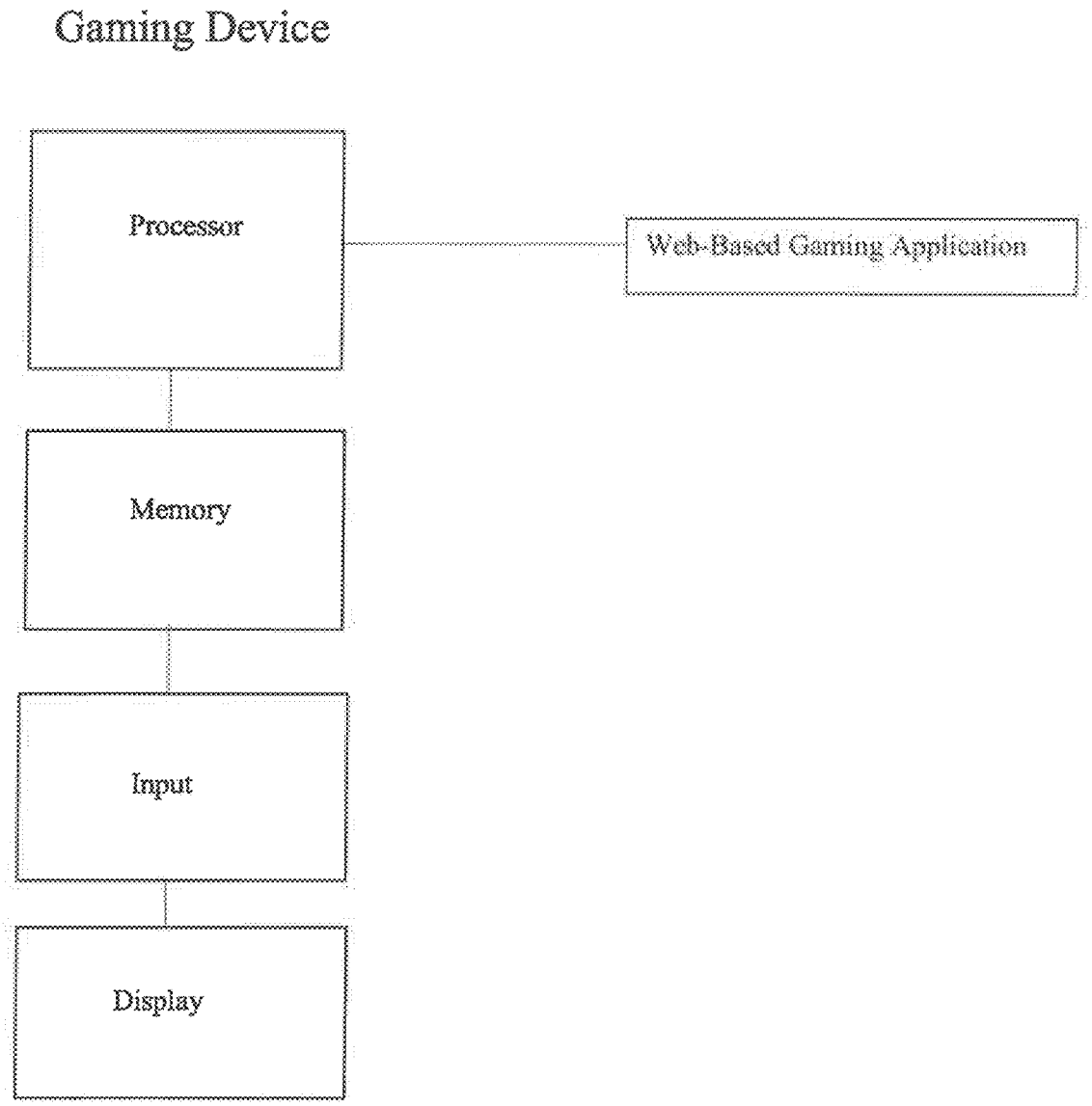
FIG. 2 is a schematic block diagram of an exemplary embodiment of an electronic configuration of a gaming device operating a web-based gaming application.
Figure 3:
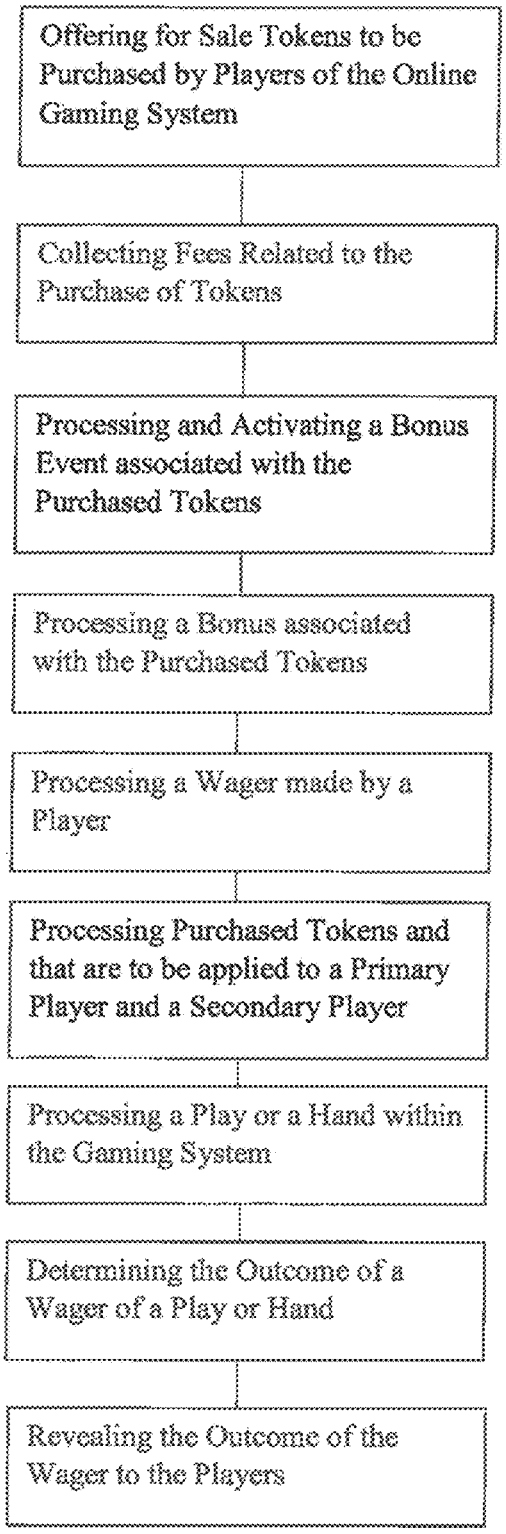
FIG. 3 is a flow chart of an exemplary embodiment of the operations of an exemplary gaming device.

The system disclosed herein is a multi-platform system that may be played on any type of computing device including personal computing devices such as computers, mobile phones, laptops, tablets and casino gaming machines and devices. According to certain aspects of the present disclosure, the gaming system is a browser-based virtual reality social casino where players may connect and gamble with each other over the internet in a social setting using their own personal computing or gaming device. Each player's gaming device is runs a software program which is operated and managed by a central controller or server. Block diagrams illustrating the gaming network are provided within FIGS. 1 and 2. FIG. 3 illustrates a flow diagram showing the various processing steps for players to interact with each other by purchasing and sharing tokens within the gaming system. These processing steps encourage continuous play and extend the length of play and enjoyment of participants of the gaming system.

The process and functions described herein may be implemented in hardware, software, firmware, or any combination thereof within a computing device. If implemented in software, the functions may be stored on or transmitted over as one or more instructions or code on a computer-readable medium. The steps of the method disclosed herein may be embodied in a processor-executable software application or module, which may reside on a tangible, non-transitory computer-readable storage medium of a computing device. Tangible, non-transitory computer-readable storage media may be any available media that may be accessed by a computer or mobile device. By way of example, and not limitation, such non-transitory computer-readable media may comprise RAM, ROM, EEPROM, CD-ROM or other optical disk storage, magnetic disk storage or other magnetic storage devices, or any other medium that may be used to store desired program code in the form of instructions or data structures and that may be accessed by a computer as well as combinations of the above. Additionally, the operations of the method disclosed herein may reside as one or any combination or set of codes and/or instructions on a tangible, non-transitory machine readable medium and/or computer-readable medium, which may be incorporated into a computer program product.

While the method of utilizing tokens within gaming, gambling and party systems has been described above in connection with various illustrative embodiments, it is to be understood that other similar embodiments may be used or modifications and additions may be made to the described embodiments for performing the same function disclosed herein without deviating therefrom. Further, all embodiments disclosed are not necessarily in the alternative, as various embodiments may be combined or subtracted to provide the desired characteristics. Variations can be made by one having ordinary skill in the art without departing from the spirit and scope hereof. Therefore, the disclosed method should not be limited to any single embodiment, but rather construed in breadth and scope in accordance with the recitations of the appended claims.

What is claimed is:

1. A gaming system comprising:

a plurality of gaming devices, wherein each gaming device has a processor, a memory, at least one input and a display, wherein the memory stores a plurality of instructions which are executed by the processor, wherein the processor executes an electronic game which includes the following steps:

offering for sale a plurality of tokens, wherein each token has a different purchase price which corresponds to a value of the respective token, wherein each token has a different value corresponding to an increased payout during a bonus event of a certain duration or on a specified duration of the bonus event, wherein the increased payout corresponds to a specific amount of game currency that is to be awarded during the duration of the bonus event;

collecting a fee related to a purchase of one of the plurality of tokens;

processing and activating a bonus associated with the purchased token, wherein the bonus comprises an amount of game currency;

processing a play or hand within the gaming system;

processing a wager associated with a player;

processing the bonus associated with the purchased token;

determining the outcome of the wager incorporating an increased payout based on a portion of the value of the purchased token;

awarding the outcome of the wager to at least one player by the gaming system, wherein the purchased token does not modify the game that is being played and only modifies the payout to the player who purchases or benefits from the token and wherein the total value of the purchased token is awarded upon completion of the bonus event; and wherein applying the purchased token to a hand or play that the player loses results in: 1) a win being registered in the player's gaming account instead of a loss; 2) a smaller loss in the player's gaming account than the player would have had had the purchased token not been applied to the hand or play.

2. The gaming system according to claim 1, wherein the purchased token has a total value that falls within a range of a first amount of game currency and a second amount of game currency, wherein the bonus event associated with the purchased token has a duration that ranges between a first time period and a second time period, wherein the processor executes a set of commands that randomly selects the amount of bonus that is awarded to the player for each play throughout the duration of the bonus event, wherein the processor executes a set of commands that randomly selects the duration of the bonus event, and wherein the processor executes a set of commands that randomly selects the amount of bonus that is awarded to the player for the duration of the bonus event and wherein the amount of bonus that is awarded to the player for the duration of the bonus event ranges between the first amount of game currency and the second amount of game currency.

3. The gaming system according to claim 2, wherein the increased payout has a value that is randomly generated for each play during the bonus event and wherein the total value of the increased payouts during the bonus event does not exceed the value of the purchased token.

4. The gaming system according to claim 3, wherein a player is provided with an option to activate a token after purchase by storing the purchased tokens within a player's account for later activation or wherein the purchased token is automatically activated after purchase.

5. The gaming system according to claim 4, wherein the gaming system comprises multiple players interacting with each other on a social network.

6. The gaming system according to claim 5, wherein the purchased token is applied to other players of the gaming system or wherein the purchased token is applied to the player who purchased the token in addition to other players of the gaming system.

7. The gaming system according to claim 6, wherein the gaming system comprises a charm party, wherein the charm party requires an admission fee to attend and wherein the admission fee to attend a charm party varies among different types of charm parties.

8. The gaming system according to claim 7, wherein the admission fee to attend a charm party requires players to purchase a token of a certain value.

9. The gaming system according to claim 8, wherein the player who purchases a token is a primary player, wherein players who have purchased the token purchased by the primary player are secondary players and wherein the value of the token purchased by the primary player is to be distributed to the secondary players attending the charm party for a period of time having a duration which corresponds to the value of the purchased token.

10. The gaming system according to claim 9, wherein the value of a specific type of token purchased during the charm party depends on the number of players attending the charm party or wherein the value of a specific type of token purchased during the charm party does not depend on the number of players attending the charm party.

11. The gaming system according to claim 10, wherein the total value of the purchased token is divided among the players attending the charm party or wherein each player attending the charm party receives the total value of the purchased token.

12. The gaming system according to claim 11, wherein the player who purchases the token has an option to purchase tokens for individual use or for sharing with other players within a charm party and wherein the player who purchases the token has a chance to be awarded increased bonus payouts in addition to increased bonus payouts associated with the purchased token if the player purchases tokens that are to be shared with other players within the charm party.

13. The gaming system according to claim 12, wherein a player who purchases high value tokens obtains a classification within the gaming system that allows the player access to purchase additional higher value tokens.

14. The gaming system according to claim 13, wherein the processor executes a set of instructions that continuously monitors and tracks the player's score, number of shared tokens, number of winning and losing hands or plays, and duration of play in real-time to compute a social gaming score and wherein the process executes a set of commands that utilizes the social gaming score to determine different types of tokens that are available for purchase.

15. The gaming system according to claim 14, wherein the gaming system comprises a charm bar which limits the number of tokens a player can play at any one period of time.

16. The gaming system according to claim 15, wherein the gaming system comprises a browser-based virtual reality world having a plurality of casinos, buildings, floors and game rooms and wherein purchased tokens and tokens obtained from other players are transferrable to different casinos, buildings, floors and game rooms within the gaming system.

17. The gaming system according to claim 16, wherein the gaming system comprises a plurality of games within a social casino, wherein the games within the social casino include slots, poker, bingo, solitaire, blackjack, baccarat, roulette, craps, keno, pachinko, lottery, big six wheel and any other type of game that requires a wager to be made.

18. A gaming system comprising:

a plurality of gaming devices, wherein each gaming device has a processor, a memory, at least one input and a display, wherein the memory stores a plurality of instructions which are executed by the processor, wherein the processor executes an electronic game which includes the following steps:

offering for sale at least one token to be purchased by multiple players within an online virtual reality gaming system, wherein the token has a value corresponding to a duration of a bonus event and an increased payout during the duration of the bonus event, wherein at least one token is required for purchase by any player who desires to obtain admission to play within the gaming system room;

collecting fees related to the purchase of the tokens;

processing and activating a bonus associated with the purchased bonus tokens, wherein the bonus is applied to all players who have obtained entry into a gaming system room;

processing the bonus associated with the purchased bonus tokens;

processing a wager associated with a primary player incorporating both the primary player's and the secondary players' purchased bonus tokens by the gaming system;

processing a play or hand within the gaming system;

determining the outcome of the wager incorporating an increased payout based on a portion of the value of the purchased token; and revealing the outcome of the wager to the primary player by the gaming system.

19. A gaming system comprising:

a plurality of gaming devices, wherein each gaming device has a processor, a memory, at least one input and a display, wherein the memory stores a plurality of instructions which are executed by the processor, wherein the processor executes an electronic game which includes the following steps:

offering for sale at least one token, wherein the token has a purchase price which corresponds to the value of the token, wherein the token has a value corresponding to an increased payout during a bonus event of a certain duration or on a specified duration of the bonus event, wherein the increased payout corresponds to a specific amount of game currency that is to be awarded during the duration of the bonus event;

collecting a fee related to the purchase of the token;

processing and activating a bonus associated with the purchased token, wherein the bonus comprises an amount of game currency;

initiating the bonus event upon activating the purchased token associated with the bonus;

processing a play or hand within the gaming system;

processing a wager associated with a player;

processing the bonus associated with the purchased token;

determining the outcome of the wager incorporating an increased payout based on a portion of the value of the purchased token; and awarding the outcome of the wager to at least one player by the gaming system, wherein the token does not modify the game that is being played and only modifies the payout to the player who purchases or benefits from the token and wherein the total value of the purchased token is awarded upon completion of the bonus event.

* * * * *